United States Patent [19]

Hamacher

[11] 4,225,157

[45] Sep. 30, 1980

[54] CASH AND CHECK REGISTER

[76] Inventor: Hubert W. Hamacher, 525 Nixon Ave., Indiana, Pa. 15701

[21] Appl. No.: 45,292

[22] Filed: Jun. 4, 1979

[51] Int. Cl.[3] ..... B41L 1/24; B42D 15/00

[52] U.S. Cl. ..... 282/23 R; 281/15 R; 282/1 R; 282/8 R; 283/58; 283/63 A

[58] Field of Search ..... 282/28 A, 1 R, 1 A, 282/2, 8 R, 8 A, 8 C, 8 B, 23 R, 23 A; 281/15 R; 283/57, 58, 63 A

[56] References Cited

U.S. PATENT DOCUMENTS

| | | | |
|---|---|---|---|
| 1,790,033 | 1/1931 | Voelcker | 283/63 R |
| 2,678,223 | 5/1954 | Shepherd | 283/58 X |
| 3,048,426 | 8/1962 | Rodriguez | 282/23 R |
| 3,254,906 | 6/1966 | Moss | 282/23 A |
| 3,257,129 | 6/1966 | Malone | 282/23 R |
| 3,315,985 | 4/1967 | Hall et al. | 283/57 |
| 3,901,537 | 8/1975 | Oldham | 282/2 |
| 3,980,323 | 9/1976 | Boyreau | 283/57 |

*Primary Examiner*—Paul A. Bell
*Assistant Examiner*—John S. Brown
*Attorney, Agent, or Firm*—Brown, Flick & Peckham

[57] ABSTRACT

In a pad of alternating original and copy sheets all of them are provided with identical information-receiving columns indicating at their top the information to be entered. Cash and check entries made on the original sheets simultaneously appear on the copy sheets, and each original sheet is removed from the pad when filled out. The back of each copy sheet carries a list of different income and expense items, each identified by a different code number for entry, where appropriate, on the underlying original sheet beside the corresponding cash or check entry.

1 Claim, 5 Drawing Figures

CASH AND CHECK REGISTER

It is among the objects of this invention to provide a register for cash disbursed and checks issued by the user, which can be used in conjunction with any standard checks, which is easy and convenient to use, which classifies the entries by code numbers identifying different items of income and expense, which serves as a permanent record, and from which filled out record sheets can be removed for processing by a computer according to the code numbers entered on the sheets.

The preferred embodiment of the invention is illustrated in the accompanying drawings, in which FIG. 1 is a plan view of the cash and check register inserted in an opened protective folder;

Figure 1:
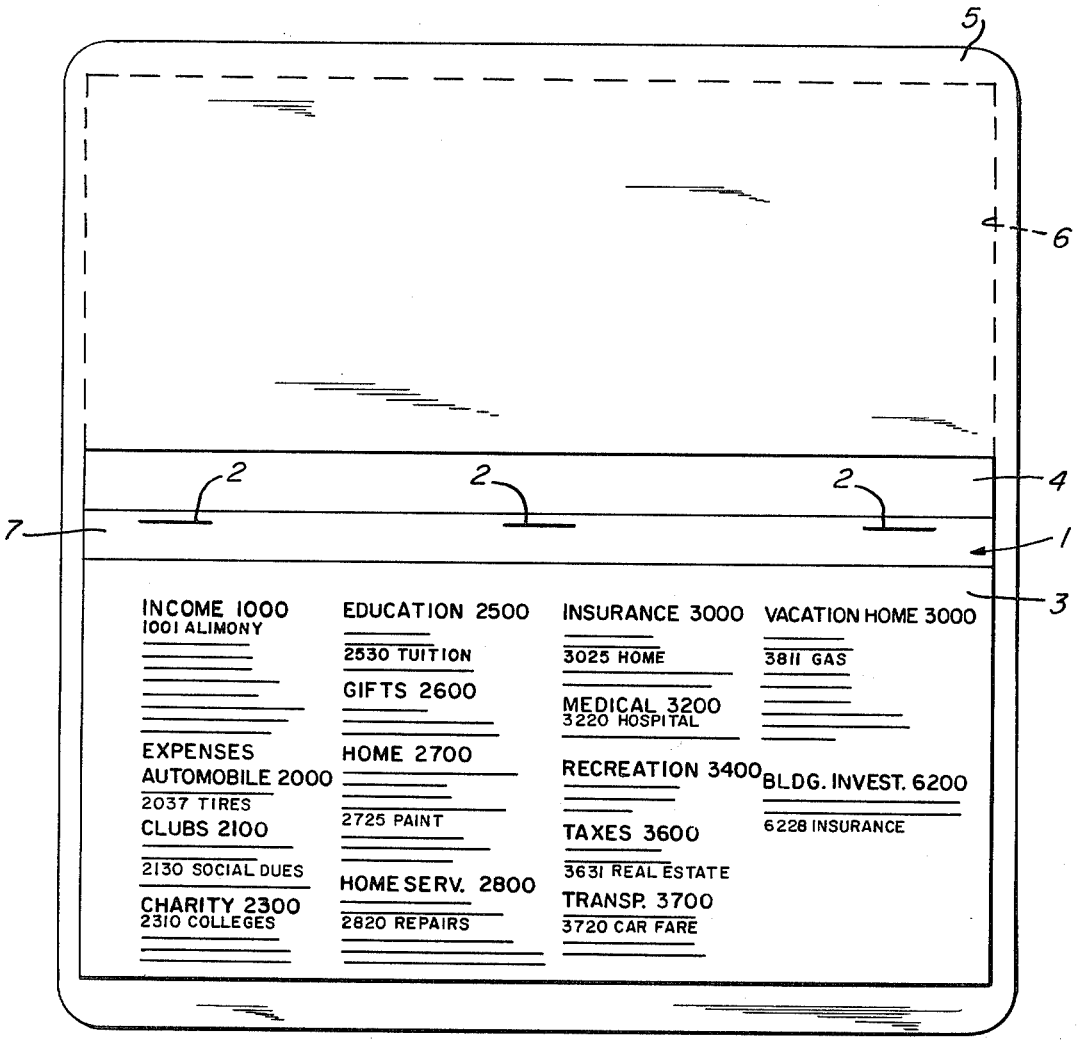
Figure 2:
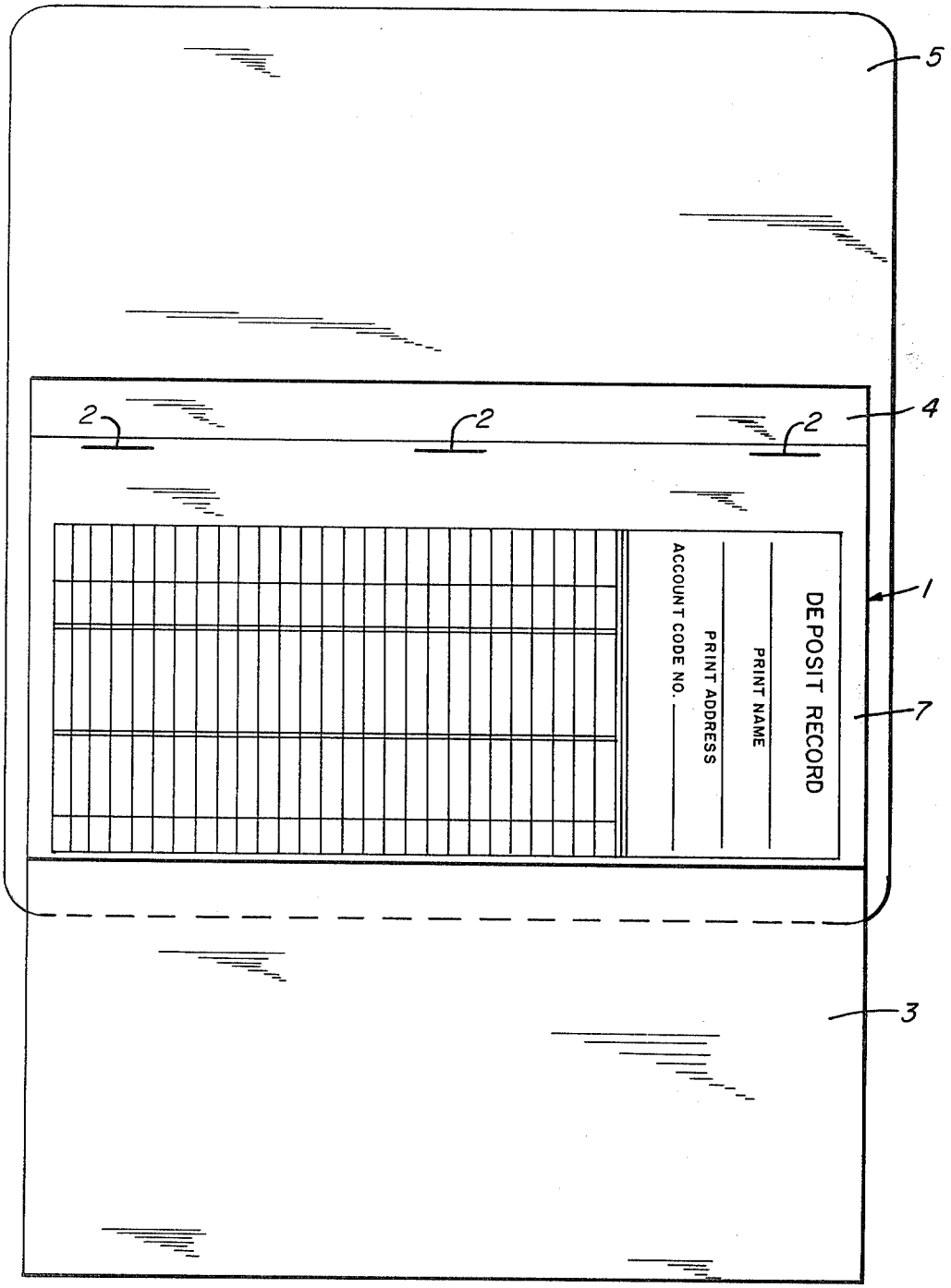
FIG. 2 is a similar view with the pad of sheets uncovered.
Figure 5:
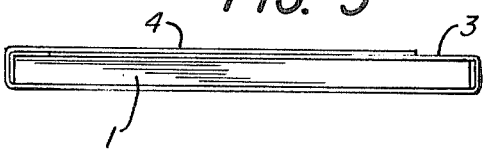
FIG. 5 is an end view of the register removed from the protective folder.

Referring to FIGS. 1, 2 and 5 of the drawings, a pad 1 of rectangular sheets is bound together along one longitudinal edge, which is called herein the top edge, by staples 2 or the like. The staples extend through the pad and through a backing sheet, the central portion of which the pad overlies. The backing sheet is a relatively stiff material, such as thin cardboard. The backing sheet projects below the lower edge of the pad to form an extension 3 that normally is folded up over the pad as shown in FIGS. 1 and 5. The backing sheet also projects beyond the upper edge of the pad to form an extension 4 that can be folded down over the folded lower extension 3 to form a cover for the pad when, as shown in FIG. 5, the register is to be used without benefit of a protective folder. However, when such a folder 5 is used, it is a rectangular member, usually made from a flexible plastic, and it is provided with a pocket 6 into which the upper extension 4 of the backing sheet is inserted to hold the register in the folder. When the pocket portion of the folder is folded over the lower half of the folder, the register is sandwiched between the two halves of the folder.

Figure 3:
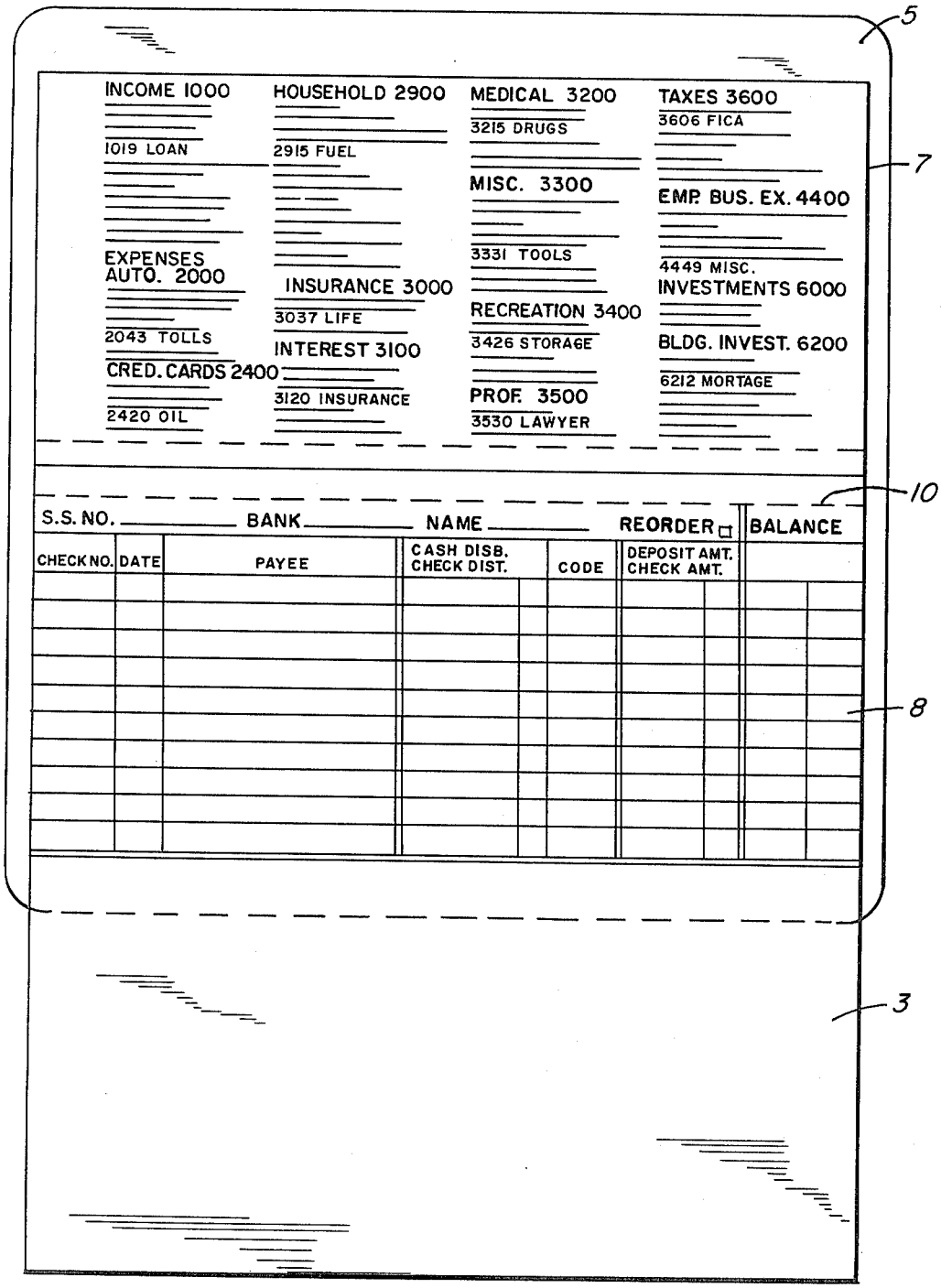
FIG. 3 shows the top sheet of the pad folded back to expose the underlying uppermost original sheet.

As shown in FIG. 2, the uppermost sheet 7 of the pad is a deposit record, on which bank deposits can be recorded in the usual manner. It is a feature of this invention that on the back of this sheet, as shown in FIG. 3, there is a long list of income and expense items separated into different categories. The headings for the different expense categories may be, for example, automobile, credit card, household, insurance, interest, medical, miscellaneous, recreation, professional, taxes, investments, etc. Under each of these headings there are subheadings that break down the expenses in that category into more specific items. For example, under automobile expenses there may be listed accessories, fuel and oil, parking, repair and tolls. Each item is identified by a different code number. In addition, the list includes an income category, under which are listed such items as salary, bonus, commissions, dividends, social security, rent income, etc., each identified by a different code number. When a deposit is entered on the deposit record, it is identified by the proper code number taken from the list on the back of the sheet. That is, if it is salary deposit, it would be identified by the code number for salary appearing in the income category.

Figure 4:
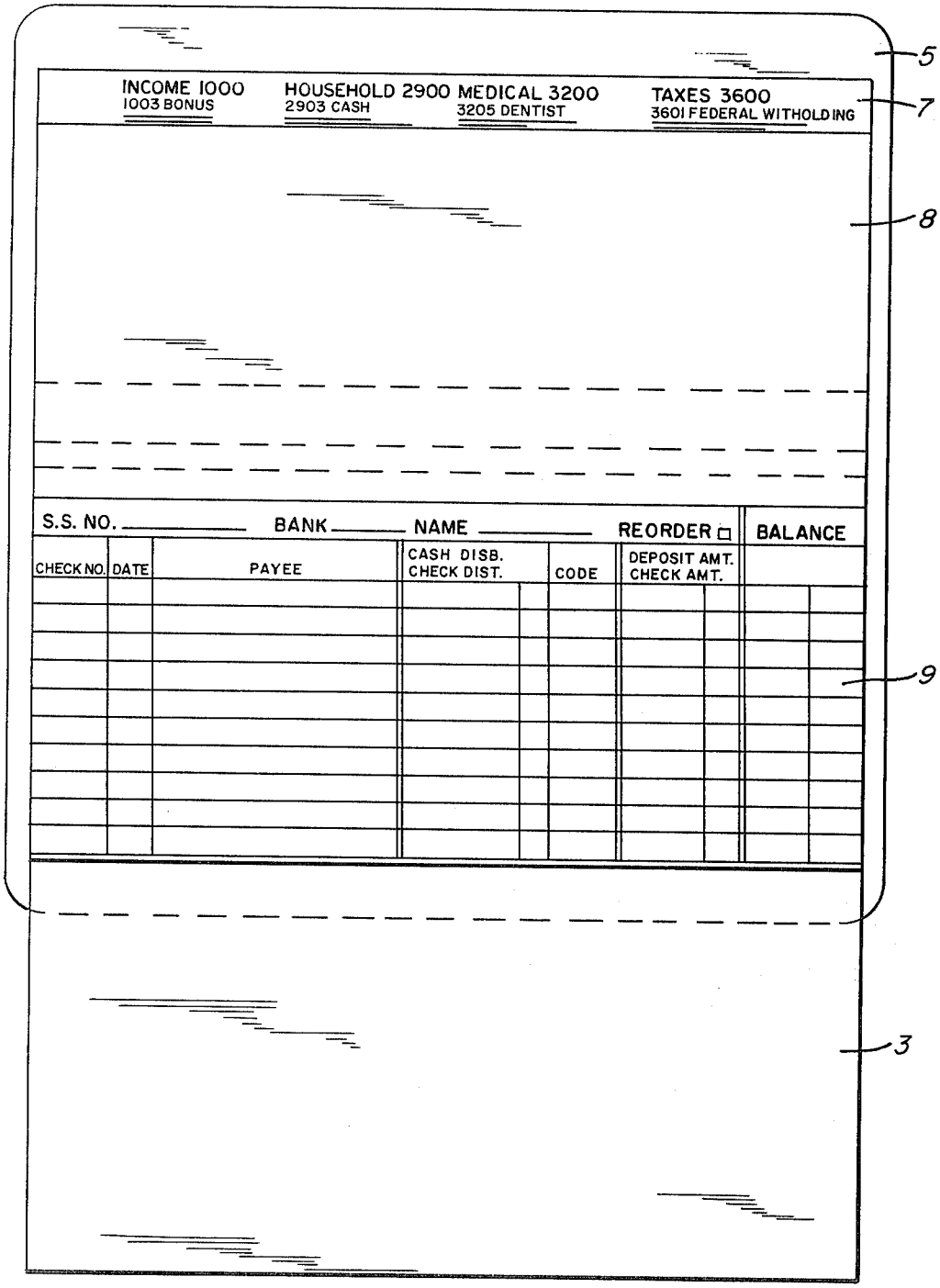
FIG. 4 shows the uppermost original sheet folded back to expose the underlying copy sheet.

Most, if not all, of the rest of the sheets in the pad consist of alternating original and copy sheets. The original sheets 8 (see FIG. 3) are those on which entries are made directly, and the copy sheets 9 (FIG. 4) are those on which the same entries appear simultaneously, due to the fact that the original sheet is treated in such a way as to act like carbon paper. This transfer type of paper is well known. All of the sheets, whether original or copy sheets, are provided with a plurality of information-receiving columns extending from top to bottom of the sheets. The columns on the copy sheet are the same as those on the original sheet. At the top of each column there is a heading designating the type of information to be entered in that column. The columns are identified for entry of the number of the check that is written, the date, the payee, the code number from the list described above, the amount of the check and the balance in the account. There also is a column showing how the amount of the check should be distributed under different code numbers in case the check is to be broken down that way. The same column is also used in case the payment is by cash rather than by check.

While the uppermost original sheet is being used, the deposit record sheet 7 is folded back so that the list of items on its back will be visible and the proper code numbers can quickly be ascertained for recording on sheet 8. The register sheets are perforated, as shown at 10 in FIG. 3, along their upper margins so that when such a sheet has been filled out it can readily be removed from the pad for preservation in a different place or for forwarding to an accountant or the operator of a computer service that will furnish the user a monthly record of his expenses. The copy sheet 9, which carries the same information as the overlying original sheet, remains in the pad. This copy sheet is folded back to expose the second original sheet 8 when it becomes necessary to enter information on the latter, due to the fact that the first original sheet has been removed. Since folding back this copy sheet covers the list of items on the back of the deposit record sheet, the back of the copy sheet is provided with the same list. This is true of the backs of all of the copy sheets. Consequently, no matter what original sheet is being filled out, the list on the back of a folded-back copy sheet is visible above it for ready reference to determine the proper code numbers to be entered on the original sheet.

The lists of items referred to above contain those most commonly used. Another list of less commonly used items, with different code numbers, is printed on the upper face of the folded-over lower extension 3 of the backing sheet. Therefore, if the desired income or expense item cannot be found on the back of a sheet in the pad, it may be found in this list on the backing sheet.

With the register described herein it is easy to keep an itemized running record of all income and expenses, without the need for a special checkbook. When the record sheets are torn from the register and sent to a computerized bookkeeping center, the code numbers allow quick classification by a computer of the various items, with an itemized print-out showing the exact condition of the account.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A cash and check register comprising a pad of rectangular sheets bound together along one longitudinal edge; said edge being the top edge of the sheets; most of said sheets being alternating original and copy sheets; a sheet directly above the uppermost original sheet having on its back a list of different income and expense items each identified by a different code number; said list being visible while entries are being made on said uppermost original sheet; each copy sheet having on its back a list the same as said first-mentioned list and visible while entries are being made on the original sheet below said copy sheet; each of said original and copy sheets being provided with a plurality of information-receiving columns extending from top to bottom thereof with each column indicating at its top the information to be entered in that column; said columns being the same on all original and copy sheets and being identified for entry of check number, date, payee, cash disbursements and check distribution, code number from said list, check amount and account balance; each original sheet being such that the entries being written on it appear on the underlying copy sheet also; the original sheets being perforated along their upper margins for easy removal from the pad for accounting purposes; and a relatively stiff backing sheet attached to the back of said pad and having an integral extension projecting beyond the lower edge of the pad and normally folded over the pad; the front of said folded extension carrying a list of different number-coded income and expense items that are different from those in said first-mentioned list; and said backing sheet also having an integral extension projecting beyond the upper edge of said pad and foldable over the other folded extension to form a register cover or a tongue for insertion in the pocket of a protective folder for the register.

* * * * *